US006305466B1

(12) United States Patent
Andersson et al.

(10) Patent No.: US 6,305,466 B1
(45) Date of Patent: Oct. 23, 2001

(54) THREE CIRCUIT PLATE HEAT EXCHANGER

(75) Inventors: Sven Andersson, Hässleholm; Thomas Dahlberg, Helsingborg, both of (SE)

(73) Assignee: SWEP International AB, Landskrona (SE)

( * ) Notice: Subject to any disclaimer, the term of this patent is extended or adjusted under 35 U.S.C. 154(b) by 0 days.

(21) Appl. No.: 09/623,792

(22) PCT Filed: Mar. 10, 1999

(86) PCT No.: PCT/SE99/00359

§ 371 Date: Sep. 8, 2000

§ 102(e) Date: Sep. 8, 2000

(87) PCT Pub. No.: WO99/46550

PCT Pub. Date: Sep. 16, 1999

(30) Foreign Application Priority Data

Mar. 11, 1998 (SE) ..... 9800783

(51) Int. Cl.[7] ..... F28F 3/08

(52) U.S. Cl. ..... 165/140; 165/167; 165/DIG. 371

(58) Field of Search ..... 165/140, 167, 165/DIG. 364, DIG. 370, DIG. 371, DIG. 372

(56) References Cited

U.S. PATENT DOCUMENTS

| | | | | |
|---|---|---|---|---|
| 2,617,634 | * | 11/1952 | Jendrassik | 165/140 |
| 5,180,004 | * | 1/1993 | Nguyen | 165/140 |
| 5,462,113 | * | 10/1995 | Wand | 165/167 |
| 6,164,371 | * | 12/2000 | Bertilsson et al. | 165/140 |

* cited by examiner

*Primary Examiner*—Allen Flanigan
(74) *Attorney, Agent, or Firm*—Breiner & Breiner, L.L.C.

(57) ABSTRACT

In a three circuit plate heat exchanger stacked plates (31–36) forming channels for two flows (y, z) of fluid which should exchange heat with a third fluid (x) are each comprising two plate areas (20) surrounding two port forming holes and four plate areas (50) surrounding four port forming holes. The said two plate areas (20) surrounding two of the port holes are displaced through a vertical distance (H) away from the areas (50) surrounding four of the port forming holes. All channel forming plates are provided with a pressed pattern the maximum pressed depth of which is=h=about H/2.

4 Claims, 4 Drawing Sheets

THREE CIRCUIT PLATE HEAT EXCHANGER

This invention relates to a three circuit plate heat exchanger.

Heat exchangers having three circuits are used where it is desirable to have a single fluid flow to exchange heat with two separate fluid flows. E. g. a flow of water may be used for evaporating or condensing two separate flows of refrigerant.

Plate heat exchangers are widely used also for exchangers having three circuits of heat exchanging media due to their low volume, weight and manufacturing cost relative to their efficiency. The plates are defining almost parallel channels for the three flows of media and are generally sealed and interconnected by brazing or soldering—preferably by vacuum brazing—although even welding or gluing may be used.

Known types of currently used three circuit heat exchangers have been described e. g. in WO 95/35474 and in WO 97/08506. The objects are to design plate heat exchangers which are reliable in use—i.e. the sealing of the channels for the heat exchanging media should remain intact during the life time of the exchanger—and to keep the manufacturing cost low.

The WO 95/35474 relates to a heat exchanger in which the plates defining the channels for the flows of the three heat exchanging media are provided with three pairs of holes defining ports connecting the inlets and the outlets of each of the three flows of fluids with the channels between the plates of the exchanger. In order to prevent each of the entering flows of fluids from passing into channels which should be passed only by the remaining two flows, said channels are blocked at the ports for each flow by interconnecting adjacent plates by brazing at ring shaped areas at the port defining holes. According to WO 95/35474 the brazing is established at ring shaped areas around the port holes having substantially different sizes. This may cause problems during the brazing operation. Also the effective plate area will decrease.

The WO 97/08506 shows a way of blocking channels from entrance of fluid from the actual port hole by use of ring shaped space between certain plates to ensure that all brazing at ring shaped sealing areas at each port hole may be performed at substantially uniform inner and outer diameters. However, this solution is more expensive and more heavy due to the extra weight of the spacers.

The present invention relates to a three circuit plate heat exchanger comprising at least ten stacked plates provided with a pressed pattern defining channels for three different flows of heat exchanging fluids; where at least six of the said stacked plates defining channels are provided with six holes;

all said channel defining plates are of equal outer dimensions, the said holes having identical locations in all plates;

the said channel defining plates having six holes are interconnected by means comprising brazing, soldering, welding or gluing at ring shaped contact areas adjacent to the holes, as well as at their outer periphery.

The present invention has for its object to provide a plate heat exchanger of the above type combing the possibility of obtaining a reliable interconnection and a low cost manufacture.

According to the present invention this is obtained thereby that said ring shaped areas of the plates adjacent to four of the said six holes are of substantially equal outer and inner shapes, the areas adapted to contact a neighboring plate at two of the holes in a plate being displaced away from a plane containing the contact areas around the remaining four holes in the plate through a distance which is about twice the distance through which the remaining, to the greatest extent displaced channel defining material in the plate has been displaced.

The invention will be described in more detail reference being made to the accompanying drawing in which FIG. 1 is a general, perspective view of a three circuit plate heat exchanger;

Figure 1:
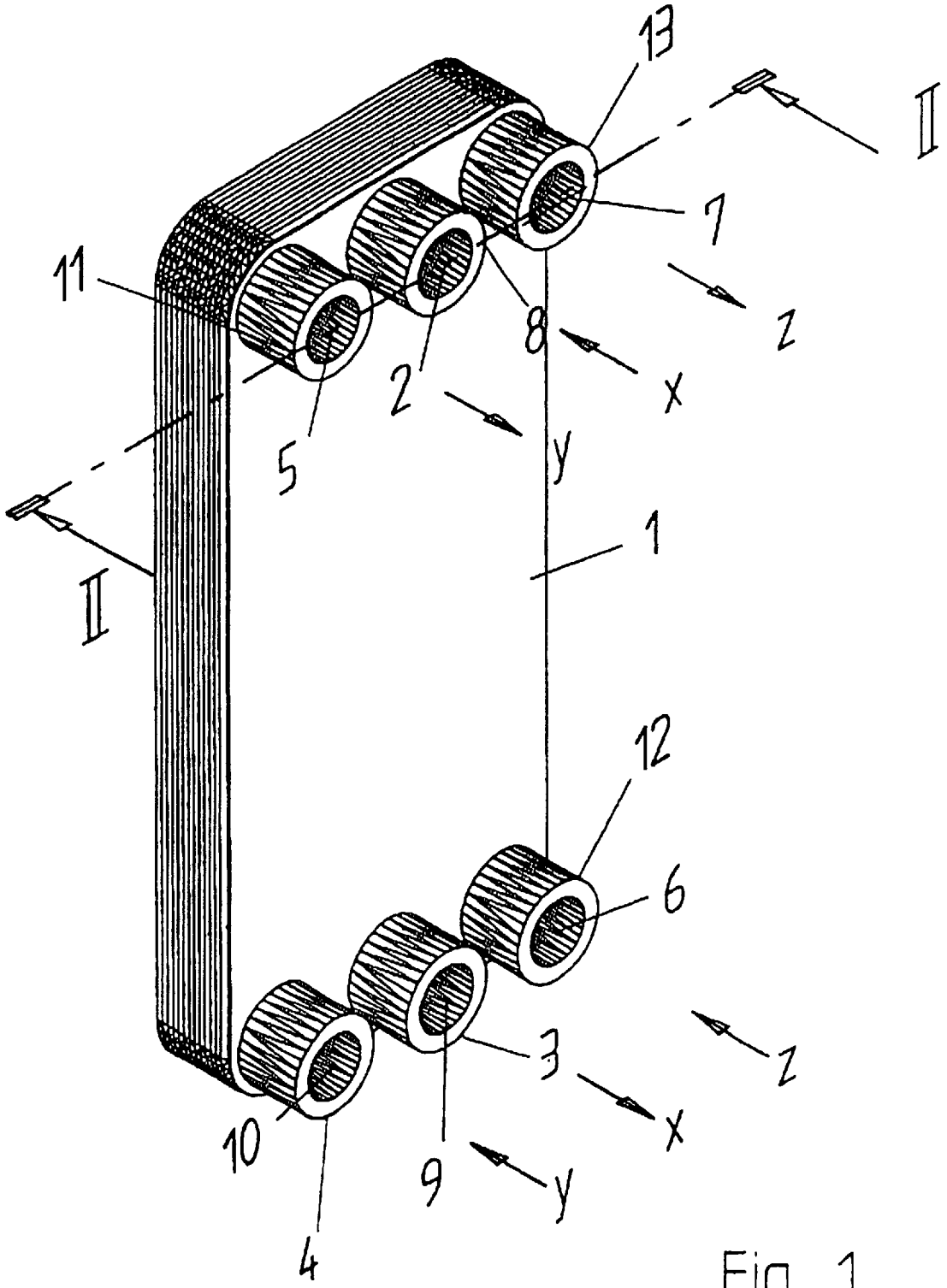

The three circuit plate heat exchanger shown in FIG. 1 has a front cover plate 1 provided with six port inlet and outlet openings 2–7 for three flows of fluid media which should pass the exchanger and exchange heat. A first flow of fluid—e.g. cooling water—has been designated by the letter x and enters the exchanger through the inlet port 2 and exits the exchanger via the outlet port 3. One of the two flows of fluid to be cooled has been designated by the letter y and enters through the inlet port 4 and exits via the outlet port 5. The other of the two flows of fluid to be cooled has been designated by the letter z and enters into the exchanger via the inlet port 6 and exits via the outlet port 7. The front cover plate 1 carries six tubular fittings 8–13 for connecting the heat exchanger to other parts of the system (not shown) in which the heat exchanging fluids are circulating. Thus the two flows y and z will pass through the heat exchanger counter-currently relative to the flow x.

Figure 2:
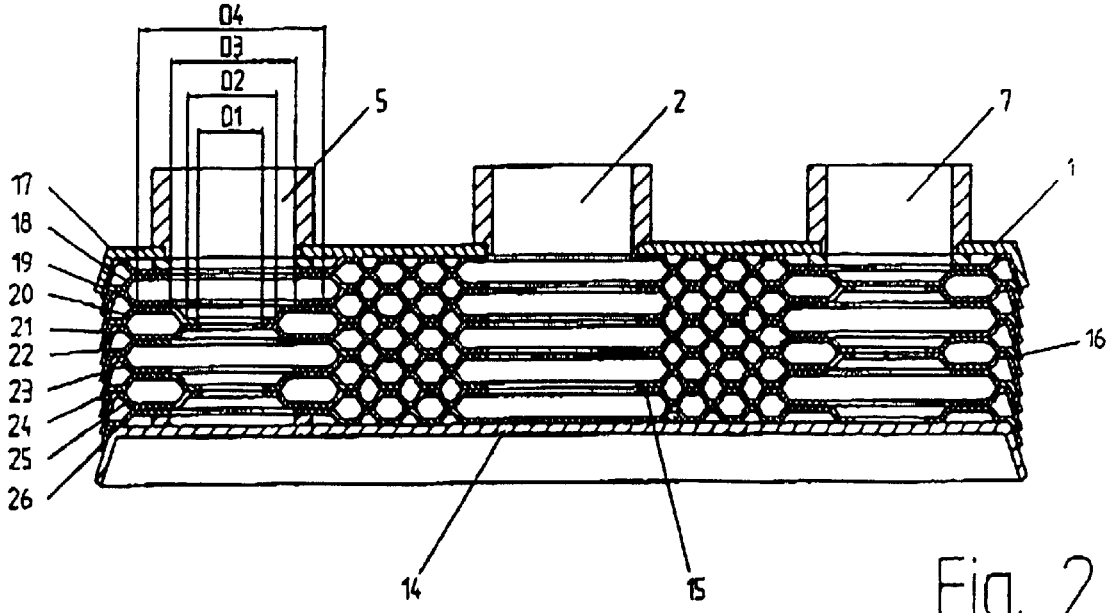
FIG. 2 is a section along the line II—II of FIG. 1 showing a prior art heat exchanger according to WO 95/35474.

FIG. 2 is a section along the line II—II of FIG. 1 showing the principle of forming channels used in three circuit heat exchangers and the principle of brazing together channel forming plates according to the prior art as illustrated in WO 95/35474. Here, the fluid x enters the exchanger through the port opening 2 in the direction towards a rear cover plate 14 through holes 15 in all plates of the exchanger except for the rear cover plate 14. The exchanger comprises ten plates provided with a pressed herring bone type pattern and a peripheral, downwardly extending collar 16. These ten plates have been designated by 17–26 and are of two types. The first type is used for the plates having odd numbers and the second type is used for the remaining plates.

The pattern provided plates 17–26 are limiting channels for the three flows of fluid and are generally arranged in pairs of two. One pair is formed by the plates 18 and 19. The pair of plates 20, 21 next to the said pair 18, 19 is basically similar thereto, but has been turned 180° in their plan relative to neighboring pairs. The outer shape of all plates and the arrangement of the six inlet and outlet ports are identical. As will be understood from FIG. 2 the ring shaped plate areas around the holes in the plates 20 and 21 at the port 5 engaging, each other to prevent the fluid x from entering into the channel between them will have to be brazed together at diameters greater than $D_1$, but smaller than $D_2$. The plates 19 and 20 should be brazed together at a ring shaped area having diameters between $D_3$ and $D_4$. As $D_1$ $D_2$, $D_3$ and $D_4$ are of increasing size the brazing of the plates forming port holes at the four ports 4–7 will have to be carried out at locations not overlapping each other in the direction of the tubular fittings—i.e. the direction perpendicular to the general plan of the plates. It may be difficult to carry out the necessary brazing operations in a reliable way. Furthermore, the maximum effective plate area will not be obtained.

Figure 3:
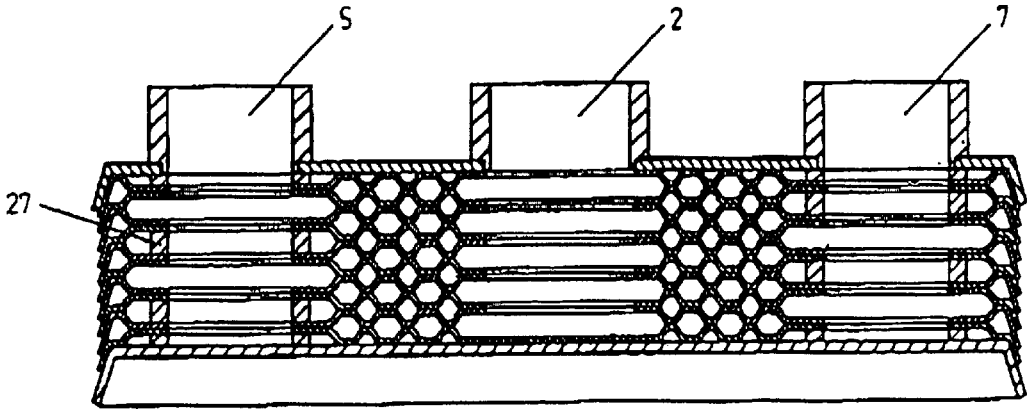
FIG. 3 is a section along the line II—II of FIG. 1 showing a prior art heat exchanger according to WO 97/08506.

This problem is solved by the proposal according to WO97/08506 the principle of which has been shown in FIG. 3. Here, the brazing of the channel forming plates near the port holes 5 and 7 has been carried out via spacer rings 27 of equal diameter. However this has been obtained by increasing the weight and the manufacturing costs.

Figure 4:
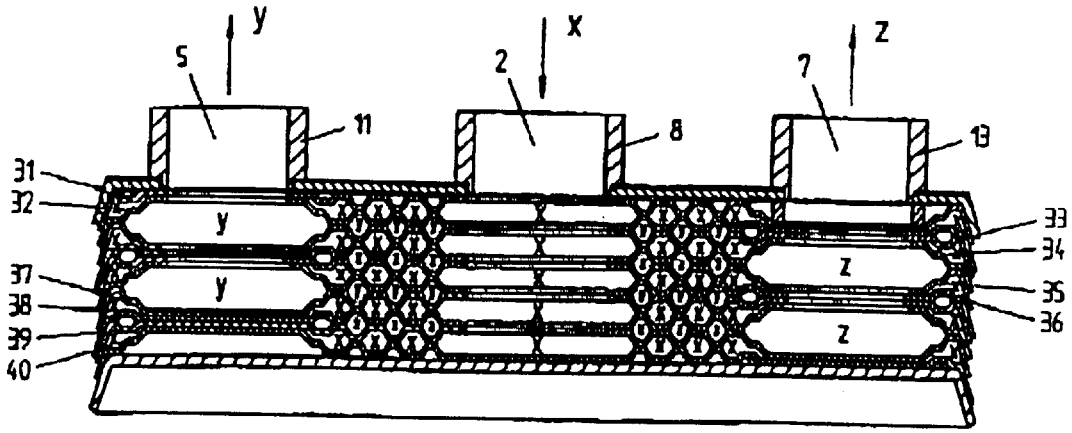
FIG. 4 is a section along the line II—II of FIG. 1 showing a heat exchanger according to the present invention.
Figure 5:
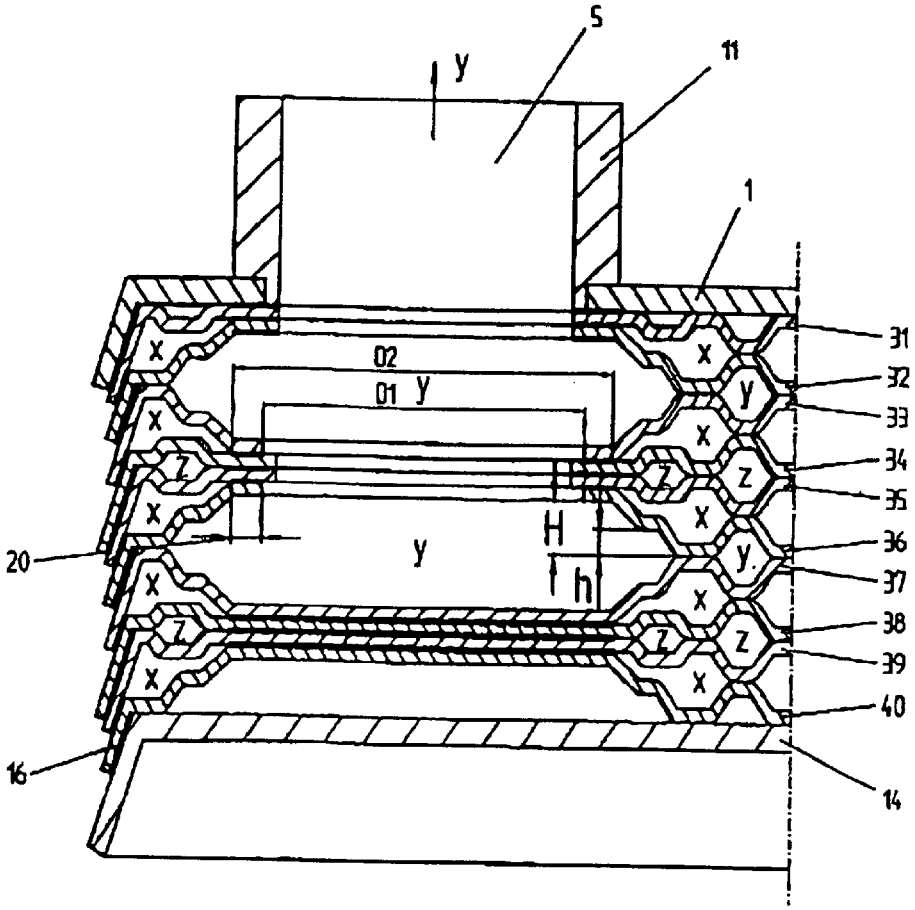
FIG. 5 is a part of FIG. 4 at a greater scale.

FIGS. 4 and 5 show a section along, the line II—II in FIG. 1 through a heat exchanger according to the present invention. Ten plates defining channels are designated by 31–40. In this embodiment the ring shaped areas of the plates 31–36 sealingly contacting each other and located adjacent to the port holes 5 and 7 are of substantially equal outer and inner diameters. The plate areas—e.g,. the ring shaped area 20 limited at the diameters $D_1$ and $D_2$ of the plate 36 of FIG. 5—adapted to contact a neighboring plate 37 at the hole 5 has been displaced away from a plan containing the contact areas around the remaining four holes in the plate through a distance H which is about double the distance h of the remaining, to the greatest extent displaced channel defining material in the plate. This has been shown in FIG. 5 which is a part of FIG. 4 at a greater scale.

Figure 6:
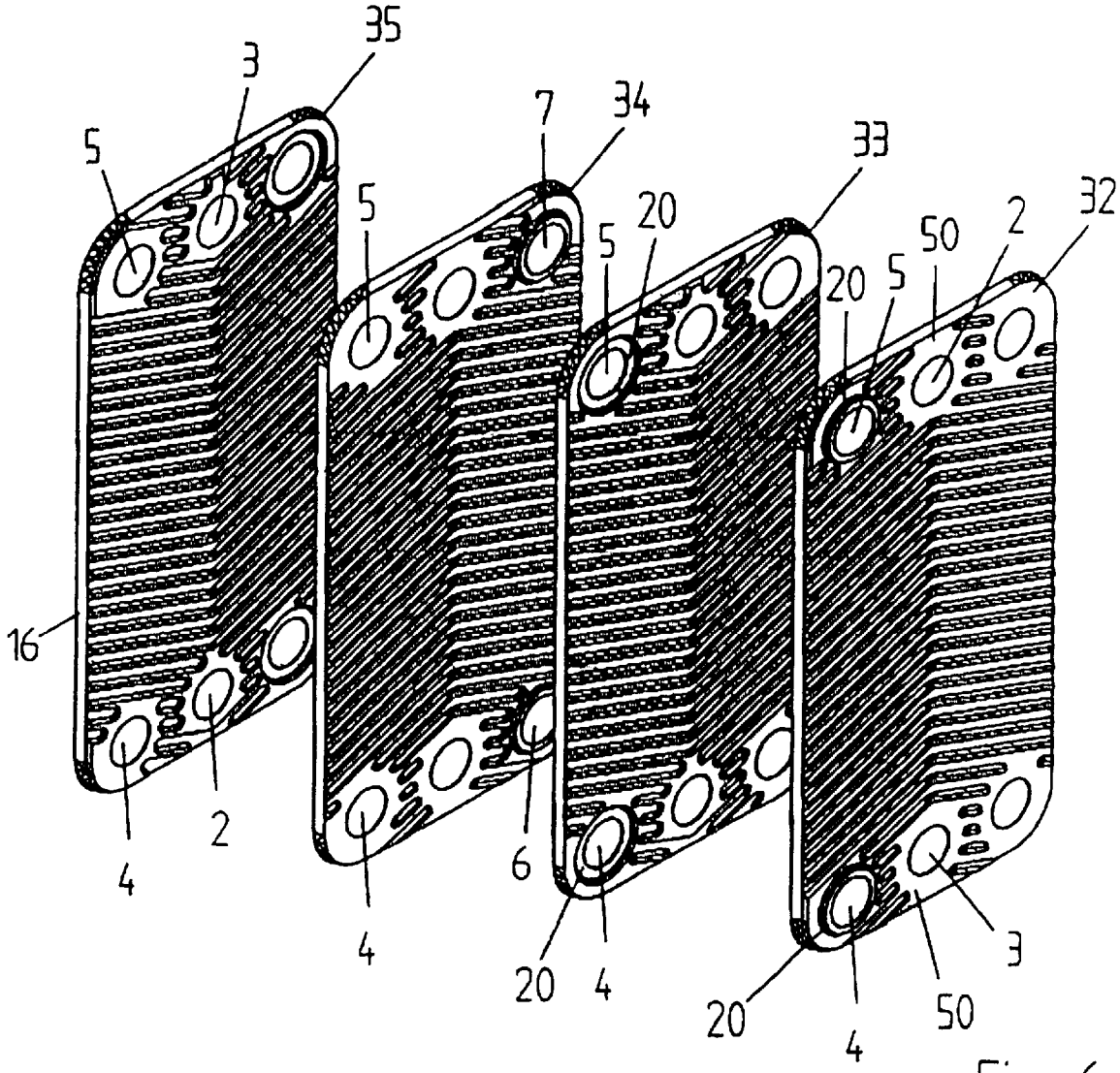
FIG. 6 is a perspective view of four plates in the exchanger of FIGS. 4 and 5 drawn apart.

FIG. 6 shows the four plates 32, 33, 34 and 35 of FIG. 4 in perspective view, but spaced apart from each other. The peripherally extending collar 16 existing at all plates has been downwardly depressed relative the parts 50 surrounding the central port holes 2 and 3. In the plate 32 a herring bone pattern has been upwardly pressed through the distance h in FIG. 5. The areas 20 surrounding the port holes 4 and 5 have been displaced through the distance H (=2×h) in the same direction (upwards) as the herring bone pattern. The following plate 33 in the stack also is provided with a herring bone pattern. However, in this plate 33 the pattern has been downwardly pressed—through the distance h—and the plate areas 20 surrounding the port holes 4 and 5 have been displaced downwardly through the distance H. When the plates 32 and 33 are placed to contact each other the distance between two adjacent areas 20 will be 2×H, whereas the plate areas 50 surrounding the remaining port holes will contact each other. The width of the channels limited by the herringbone pattern depressions will be 2×h. Plate No. 3 in the stack (the plate 34) is provided with a herring bone pattern upwardly pressed relative the areas 50 through the distance h. The plate areas of the plate 34 around the port holes 4 and 5 are not displaced, but so are the plate areas 20 around the port holes 6 and 7 in the same direction as the herring bone pattern—i.e. upwardly, but through the distance H. Thus the plate areas around the port holes 4 and 5 of the plates 33, 34 will contact each other, and the displaced areas 20 of the plate 34 around the port holes 7 and 8 will contact the non-displaced plate areas around the corresponding holes in the plate 33. Finally, the plate 35 in the stack will have a herring bone pattern displaced downwardly through the distance h relative to the plate areas 50 around the port holes 2, 3, 4 and 5. The plate areas 20 around the port holes 6 and 7 are displaced downwardly through the distance H. In FIG. 5 the channels defined by the plates have been marked with the letters x, y and z according to their contents of fluids.

The plate 36 in the stack—not shown in FIG. 6—will have the same shape as that of the plate 32 and will start a new series of plates.

From FIGS. 4 and 5 it will appear that the size of the port holes in the plates located at the ports 4–7 may vary slightly. This is due to the traditional way of manufacturing the heat exchanger plates. The plates are initially stamped to the desired size with uniform diameters of the holes. Subsequently the plates are exposed to one or more pressing operations. The more the plates are deformed during the pressing operations the more the holes will be enlarged. Therefore, the holes near the areas having been displaced through the distance H will be greater than the holes near areas not displaced or only displaced through the distance h. Said small variations are in fact advantageous as they will facilitate the brazing connections.

In the above described embodiment the ring shaped contact areas 20 are shown as substantially limited by circular borders having the diameters D1 and D2. However, the holes in the channel forming plates (31–37) need not be circular. They could as well be of other shape—e. g. elliptic or polygonal shape. Only their size, shape and position should be substantially identical.

What is claimed is:

1. A three circuit plate heat exchanger comprising at least ten stacked plates (31–40) provided with a pressed pattern defining channels for three different flows (x, y, z) of heat exchanging fluids; where at least six (31–36) of the said stacked plates (31–40) defining channels are provided with six holes;

all said channel defining plates (31–40) are of equal outer dimensions, said holes having identical locations in all plates (31–36);

said channel defining plates (31–36) having six holes are interconnected by means comprising brazing, soldering, welding or gluing at ring shaped contact areas (20) adjacent to the holes, as well as at their outer periphery, characterized in that said ring shaped areas (20) of the plates (31–36) adjacent to four of said six holes are of substantially equal outer and inner shapes, the areas (20) adapted to contact a neighboring plate at two of the holes in a plate being displaced away from a plane containing the contact areas around the remaining four holes in the plate through a distance (H) which is about twice a distance (h), wherein said distance (h) is defined by the greatest extent to which the remaining channel defining material in the place has been displaced from said plane.

2. A three circuit plate heat exchanger according to claim 1, characterized in that said ring shaped areas (20) of the plates (31–36) adjacent to four of said holes are limited by substantially circular inner and outer borders.

3. A three circuit plate heat exchanger according to claim 1 or 2, characterized in that said channel defining plates (31–36) are interconnected by vacuum brazing.

4. A three circuit plate heat exchanger according to claim 1 or 2, characterized in that said channel defining plates (31–36) are interconnected by brazing, in a controlled atmosphere.

* * * * *

UNITED STATES PATENT AND TRADEMARK OFFICE

CERTIFICATE OF CORRECTION

PATENT NO. : 6,305,466 B1
DATED : October 23, 2001
INVENTOR(S) : Sven Andersson et al.

It is certified that error appears in the above-identified patent and that said Letters Patent is hereby corrected as shown below:

Column 2,
Line 61, delete the comma after "engaging";

Column 4,
Line 49, "place" should read -- plate --.

Signed and Sealed this

Thirtieth Day of April, 2002

*Attest:*

*Attesting Officer*

JAMES E. ROGAN
*Director of the United States Patent and Trademark Office*